US009545552B1

(12) United States Patent
Buchweitz, III

(10) Patent No.: US 9,545,552 B1
(45) Date of Patent: Jan. 17, 2017

(54) HOOP MOUNTING

(71) Applicant: Albert F. Buchweitz, III, Liberty Township, OH (US)

(72) Inventor: Albert F. Buchweitz, III, Liberty Township, OH (US)

( * ) Notice: Subject to any disclaimer, the term of this patent is extended or adjusted under 35 U.S.C. 154(b) by 0 days.

(21) Appl. No.: 15/045,211

(22) Filed: Feb. 16, 2016

Related U.S. Application Data

(60) Provisional application No. 62/116,127, filed on Feb. 13, 2015.

(51) Int. Cl.
*A63B 63/08* (2006.01)

(52) U.S. Cl.
CPC ..... *A63B 63/083* (2013.01)

(58) Field of Classification Search
CPC ..... A63B 63/08; A63B 63/083
USPC ..... 473/398–402, 479–489
See application file for complete search history.

(56) References Cited

U.S. PATENT DOCUMENTS 922,630 A * 5/1909 Reach ..... A63B 63/083 248/315
2,932,511 A * 4/1960 Bemis ..... A63B 63/083 248/156
4,887,812 A * 12/1989 Moormann ..... A63B 63/083 248/224.61
5,123,654 A * 6/1992 Liu ..... A63B 67/083 273/402
5,222,259 A * 6/1993 Bristor ..... A41D 13/0015 2/108
5,240,259 A * 8/1993 O'Grady ..... B43M 99/009 206/350
5,300,920 A * 4/1994 Caselli ..... A63B 24/0021 473/480
5,358,237 A * 10/1994 Yu ..... A63B 63/083 273/382
5,570,880 A * 11/1996 Nordgran ..... A63B 63/083 248/218.4
5,823,897 A * 10/1998 Wang ..... A63B 63/083 473/481
5,842,941 A * 12/1998 Siminski ..... A63B 63/083 273/157 R
5,893,809 A * 4/1999 Coats ..... A63B 63/083 473/479
6,074,313 A * 6/2000 Pearson ..... A63B 63/083 273/394
6,344,005 B1 * 2/2002 Lin ..... A63B 63/083 473/415

(Continued)

*Primary Examiner* — Mark Graham
(74) *Attorney, Agent, or Firm* — Wood Herron & Evans LLP

(57) ABSTRACT

A backboard and hoop device is assembled from a backboard section and a hoop section, using first and second curved tangs at the proximal end of the hoop section, and first and second hooked tangs at the proximal end of the hoop section. The backboard section includes spaced first and second apertures sized to permit rotation of the curved tangs therein, and third and fourth apertures sized to permit engagement of the hooked tangs when aligned by rotation of the curved tangs, permitting assembly of the backboard section. The device further incorporates a mounting post clamp comprising two pairs of first and second jaws, one of each pair of jaws being mountable in a vertical or horizontal orientation to the backboard member, and the other of each pair of jaws engaged to a vertical or horizontal mounting post.

5 Claims, 7 Drawing Sheets

(56) References Cited

U.S. PATENT DOCUMENTS

| | | | | |
|---|---|---|---|---|
| 8,651,492 | B1 * | 2/2014 | Cappuccio | A63B 67/002 273/317 |
| 2003/0153414 | A1 * | 8/2003 | Nye | A63B 63/083 473/485 |
| 2004/0038760 | A1 * | 2/2004 | Diaz | B65F 1/141 473/485 |
| 2004/0214665 | A1 * | 10/2004 | Kane | A63B 63/083 473/433 |
| 2006/0058123 | A1 * | 3/2006 | Publicover | A63B 63/083 473/485 |
| 2008/0200286 | A1 * | 8/2008 | Zamski | A63B 63/083 473/433 |
| 2016/0051874 | A1 * | 2/2016 | Ko | A63B 63/083 473/482 |

* cited by examiner

HOOP MOUNTING

RELATED APPLICATIONS

This non-provisional application claims priority to provisional application Ser. No. 62/116,127 filed Feb. 13, 2015, which is incorporated herein in its entirey.

FIELD OF THE INVENTION

The present invention generally relates to sporting equipment, more specifically sporting equipment for mounting a hoop for a basketball type game on a boat, trampoline or at another location.

BACKGROUND OF THE INVENTION

Basketball and related hoop games are often played in offices, on boats, trampolines and homes. While a number of portable or movable basketball hoop systems are known on the market, there remains a need for a system that can be used to provide a variety of fun hoop games, is light weight, easily assembled, and is of minimal size when not being used.

SUMMARY OF THE INVENTION

Basketball and related hoop games are often played in offices, on boats, trampolines and homes. While a number of portable or movable basketball hoop systems are known on the market, there remains a need for a system that can be used to provide a variety of fun hoop games, is light weight, easily assembled, and is of minimal size when not being used.

BRIEF DESCRIPTION OF THE DRAWINGS

The accompanying drawings, which are incorporated in and constitute a part of this specification, illustrate embodiments of the invention and, together with the general description of the invention given above, and the detailed description given below, serve to explain the principles of the invention.

DETAILED DESCRIPTION OF THE DRAWINGS

Figure 1:
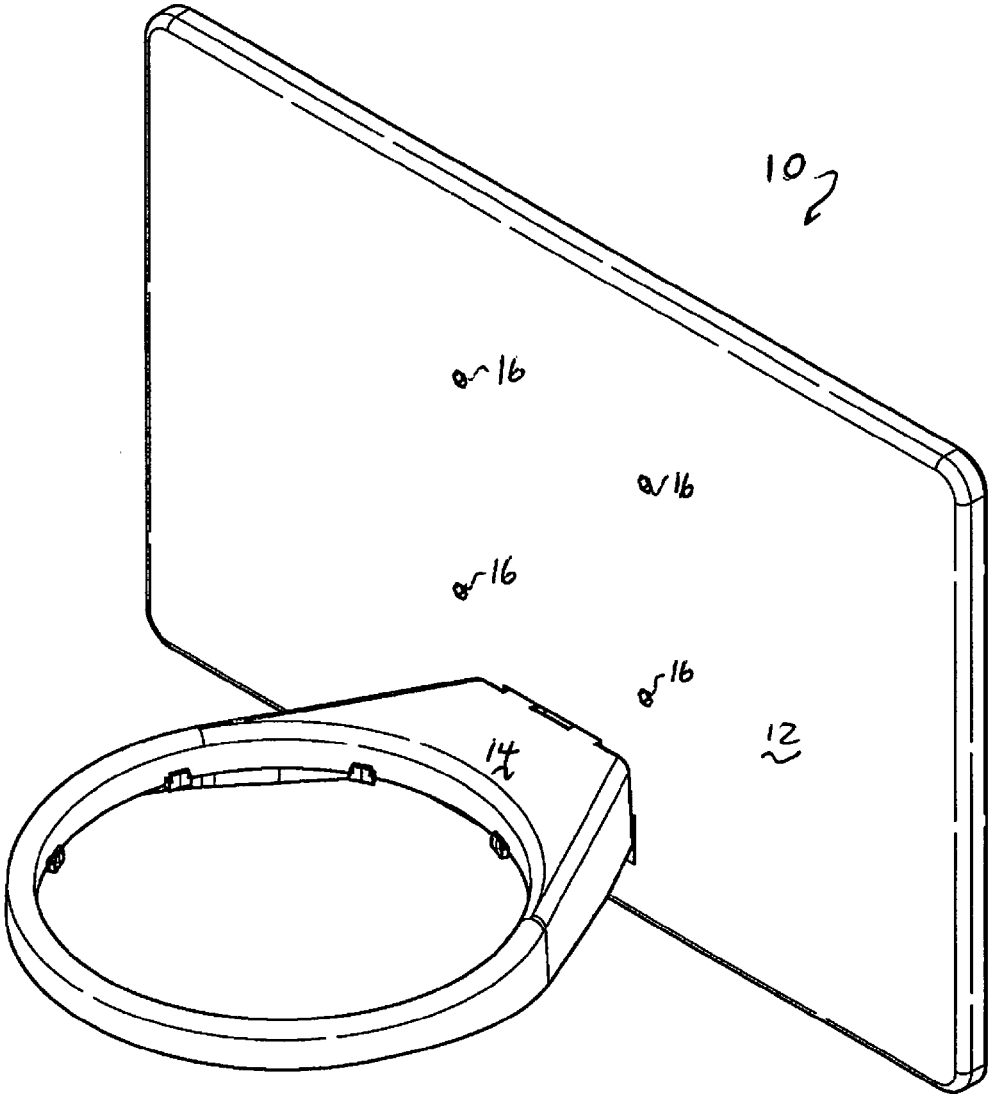
FIG. 1 is a perspective view of a backboard and hoop in accordance with principles of the present invention.

Referring now to FIG. 1, a perspective view of a backboard and hoop 10 in accordance with principles of the present invention illustrates the backboard 12, which is generally flush on its forward face and features four mounting holes 16, and the hoop member 14 which is mounted to the backboard 12 by a mounting means such as is described below. The backboard 12 and hoop 14 may be made of any suitable material, such as injection molded plastic, composite materials such as carbon fiber, or any other resilient and wear resistant material.

Figure 2A:
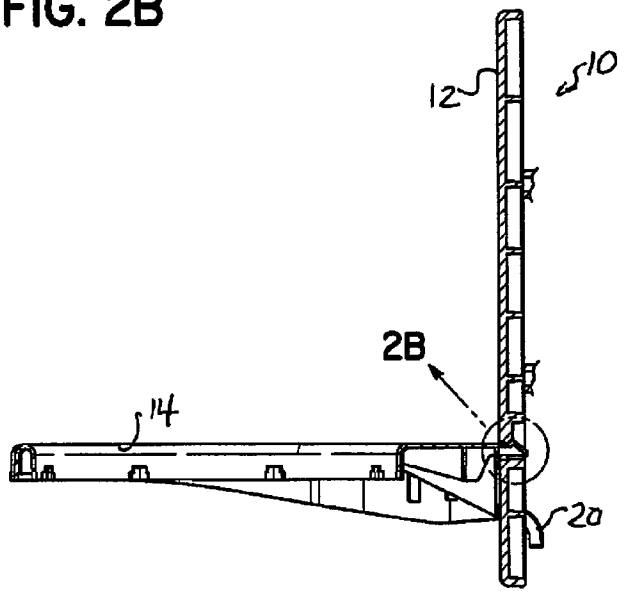
FIG. 2A is a cross sectional view of the connecting structure of the backboard and hoop of FIGS. 1 and 2, taken along the line 2A-2A on FIG. 2, showing a sectional view of the hooked tangs on the proximal end of the hoop which engage the backboard.
Figure 2B:
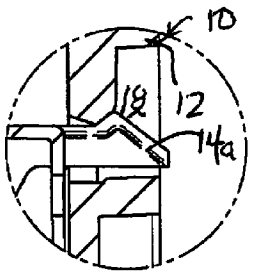
FIG. 2B is a detail view of the area identified in the circle 2B in FIG. 2A, showing the hooked tangs at the proximal end of the hoop and their engagement into the mating holes in the backboard.
Figure 2:
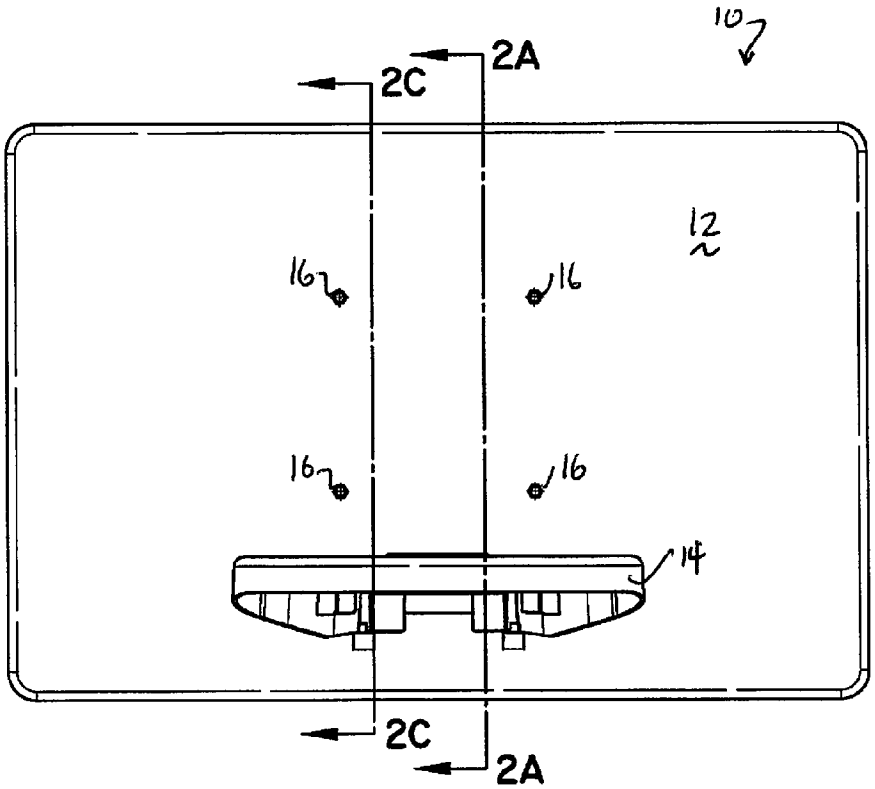
FIG. 2 is a front view of the backboard and hoop of FIG. 1.

FIG. 2 illustrates the backboard and hoop 10 assembly in front view, where it can be seen that the mounting holes 16 are relatively evenly spaced on backboard member 12, and centered above the hoop member 14.

The cross-section view shown in FIG. 2A illustrates the connecting structure of the backboard and hoop of FIGS. 1 and 2, taken along the line 2A-2A on FIG. 2. The proximal surface of the hoop member 14 includes, as seen in section, hooked tangs 14*a* which engage to mating apertures on the backboard 12. The details of this engagement are seen in the FIG. 2B detail view, which particularizes the area identified in the circle 2B in FIG. 2A. As seen, the hooked tangs at the proximal end of the hoop and engage into mating holes in the backboard with an interference fit.

Figure 2C:
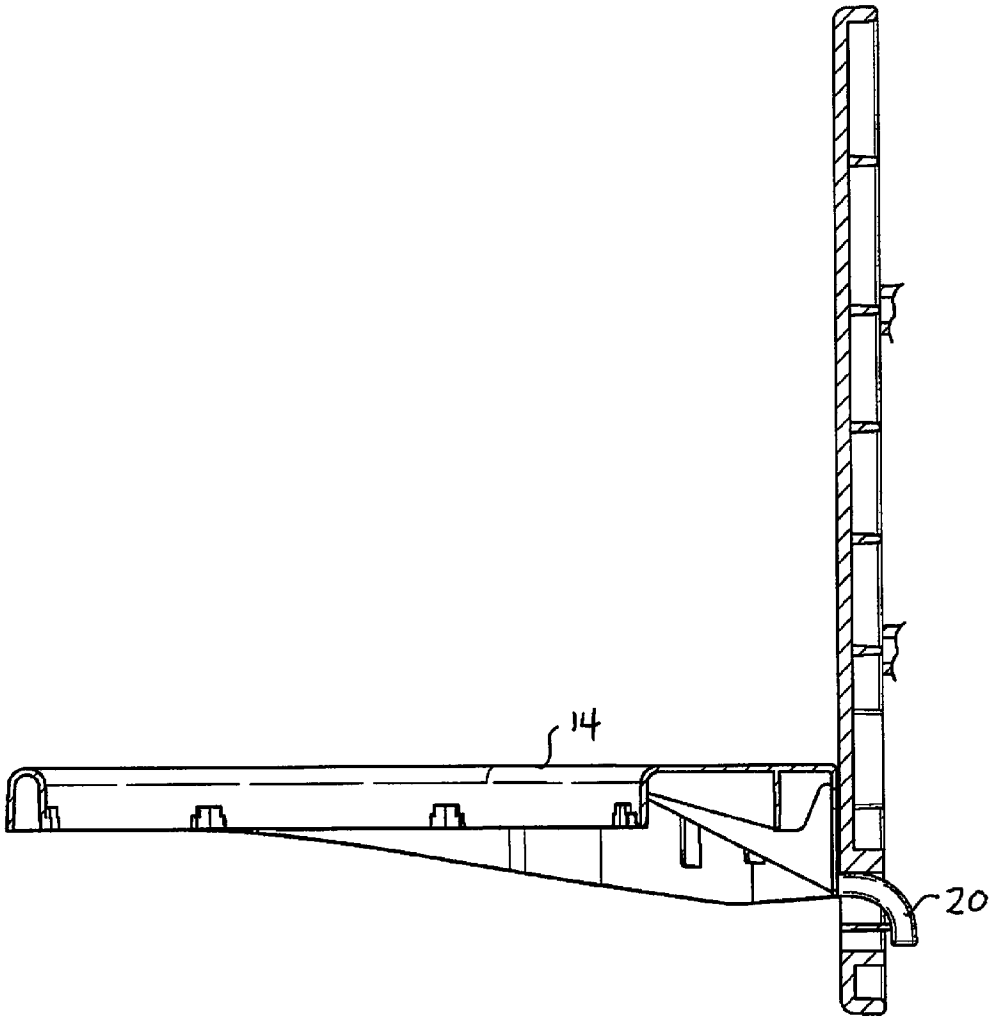
FIG. 2C is a cross sectional view of the connecting structure of the backboard and hoop of FIGS. 1 and 2, taken along the line 2C-2C on FIG. 2, showing a sectional view of the curved tangs at the proximal end of the hoop which engage the backboard.

The proximal end of the hoop member 14 further includes curved tangs 20, seen in FIG. 2C, which is a cross sectional view of the connecting structure of the backboard and hoop of FIGS. 1 and 2, taken along the line 2C-2C on FIG. 2. The curved tangs 20 rotate into engagement through matable apertures in the backboard member 12, positioning the hooked tanks 14*a* for engagement as seen in FIGS. 2A and 2B, and providing a vertical support for the hoop member 14 when installed in the backboard member 12.

Figure 3:
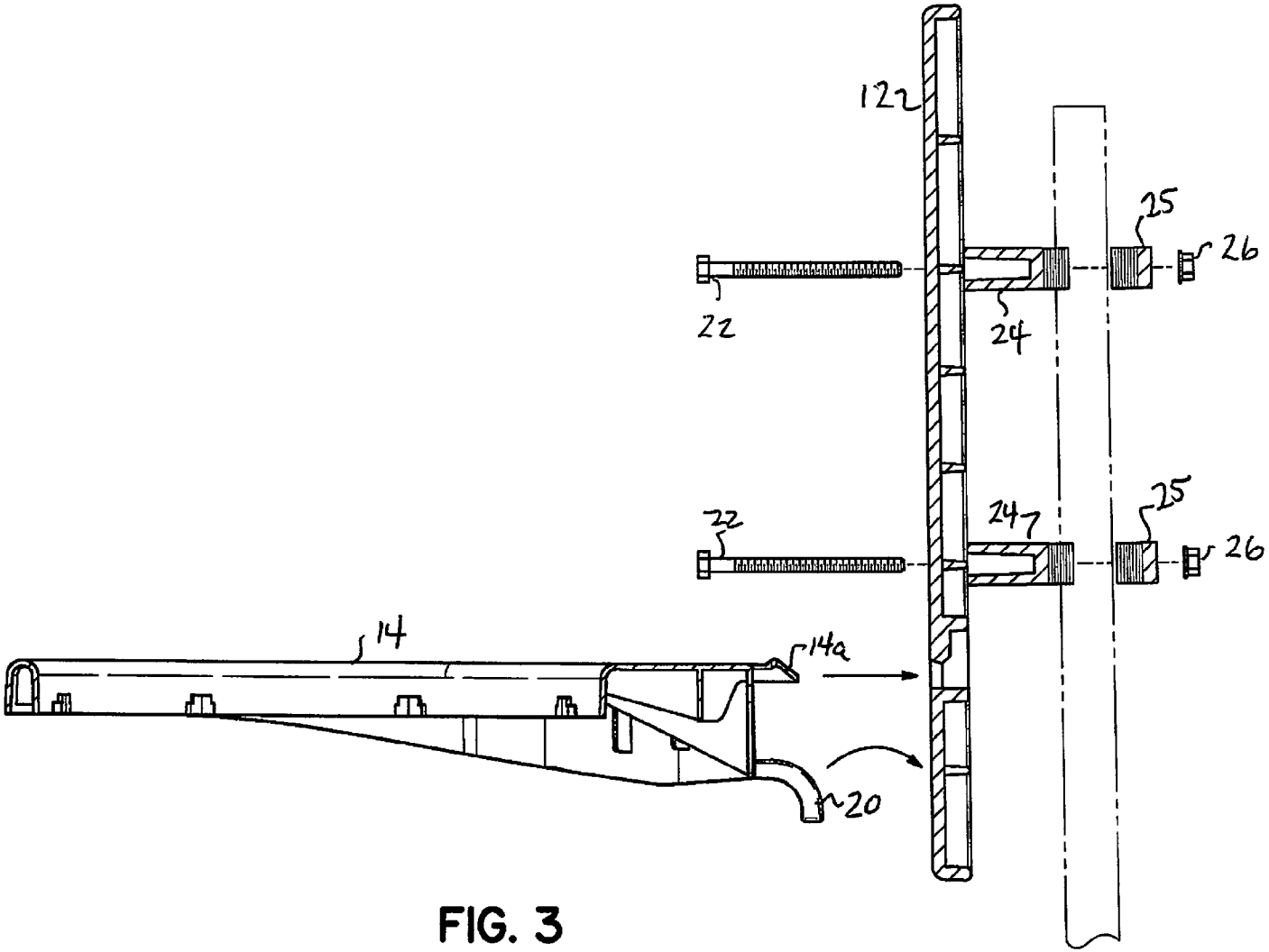
FIG. 3 is an assembly drawing showing the process for assembling the curved and hooked tangs into the backboard to create a complete backboard assembly, and showing the installation of mounting bolts into the backboard to assemble the mounting clamps around a mounting post (shown in phantom).

The assembly process is seen in detail in FIG. 3; the hoop member 14 is assembled to the backboard member 12 by insertion of the curved tangs 20 into the backboard member 12 and rotation of the hoop member 14 until the hooked tangs engage to the apertures in the backboard to create a complete backboard assembly.

FIG. 3 further illustrates the installation of mounting bolts 22 into the backboard through holes 16 (FIG. 1-2) to assemble the backboard member 12 to mounting clamps 24 and 25 which are usable to mount the backboard member 12 to a mounting post (shown in phantom).

Figure 4:
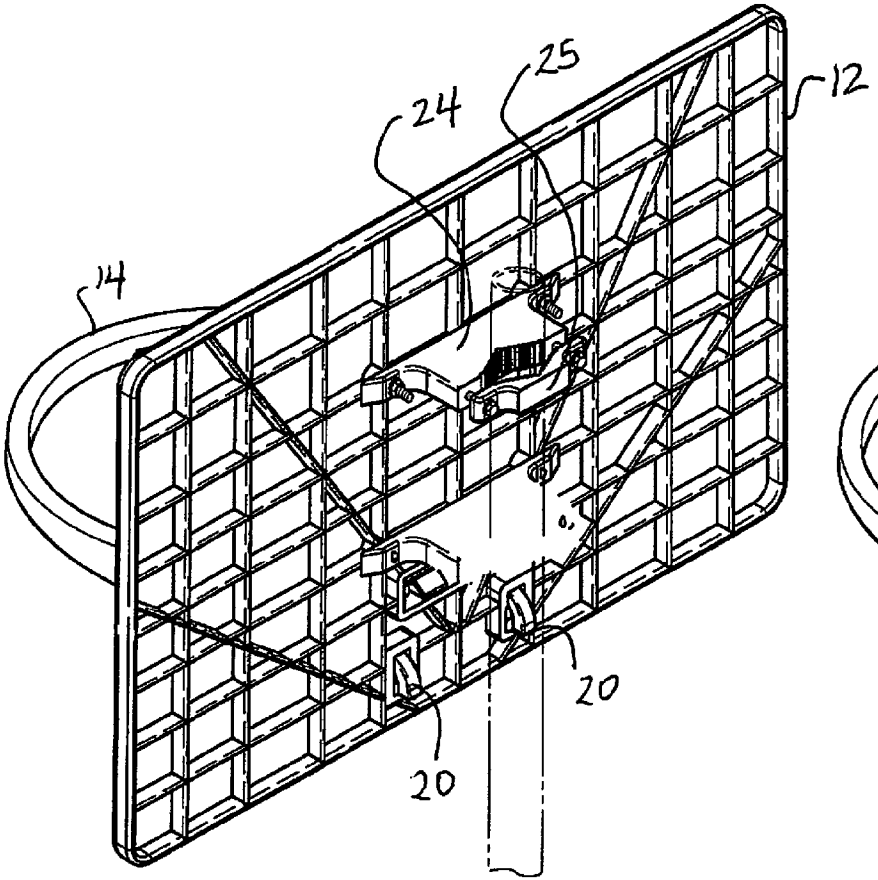
FIG. 4 is an illustration of the mounting clamps engaged to and clamping a vertical mounting post (shown in phantom).

FIG. 4 shows a perspective view of the mounting clamps 24 and 25, engaged to and clamping a vertical mounting post (shown in phantom). Mounting bolts 22 are installed through backboard member 12 holes 16, and engage mounting clamp 24 to the back side of backboard 12. Mounting clamp 25 is positioned over the vertical mounting post and bolted to mounting clamp 24 with additional mounting bolts

23. The surfaces of clamps 24 and 25 which engage to the mounting post are knurled for increased friction, thus engaging the backboard and hoop firmly to the mounting post.

Figure 5:
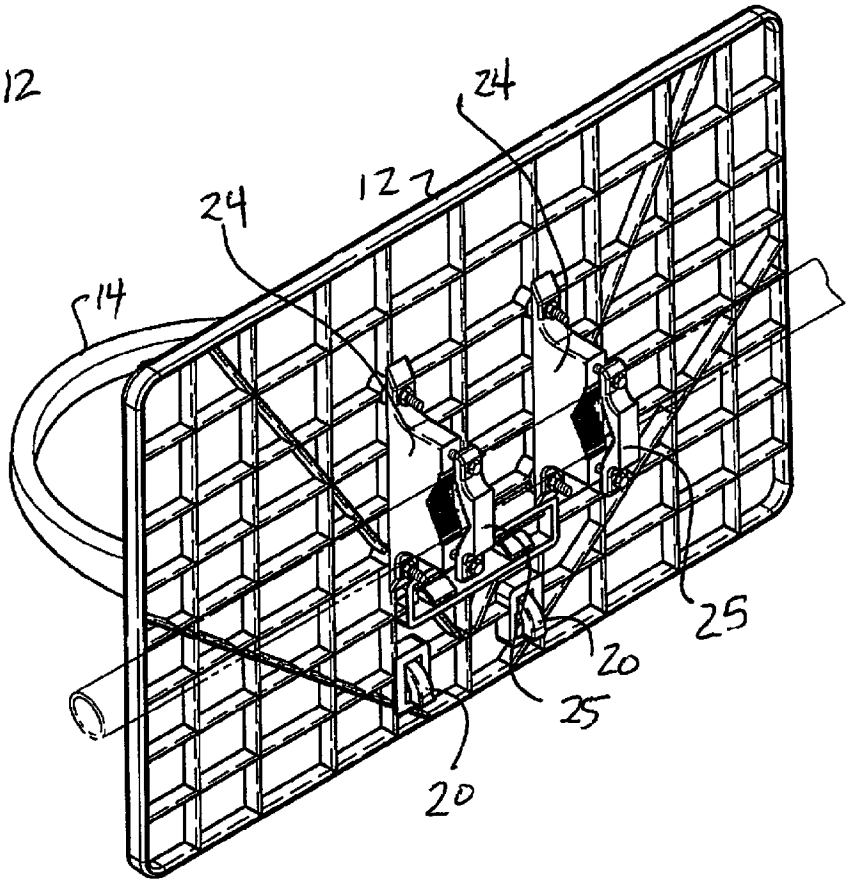
FIG. 5 is an illustration of the mounting clamps rotated to a horizontal position and engaged to and clamping a horizontal mounting post (shown in phantom).

The mounting clamps 24 and 25 may also be used with a horizontal mounting post. FIG. 5 illustrates that mounting clamps may be rotated to a horizontal position and engaged to clamp a horizontal mounting post (shown in phantom). The holes 16 in the backboard are positioned at the corners of a square so that they can be aligned with the mounting clamps 24 in either a horizontal or vertical direction.

Comparing FIGS. 4 and 5 it can be seen that the mounting clamps permit the use of either a horizontal or vertical mounting post, and further, can clamp a wide range of mounting post dimensions by increasing or decreasing the distance between the clamping jaws of clamps 24 and 25.

Figure 6:
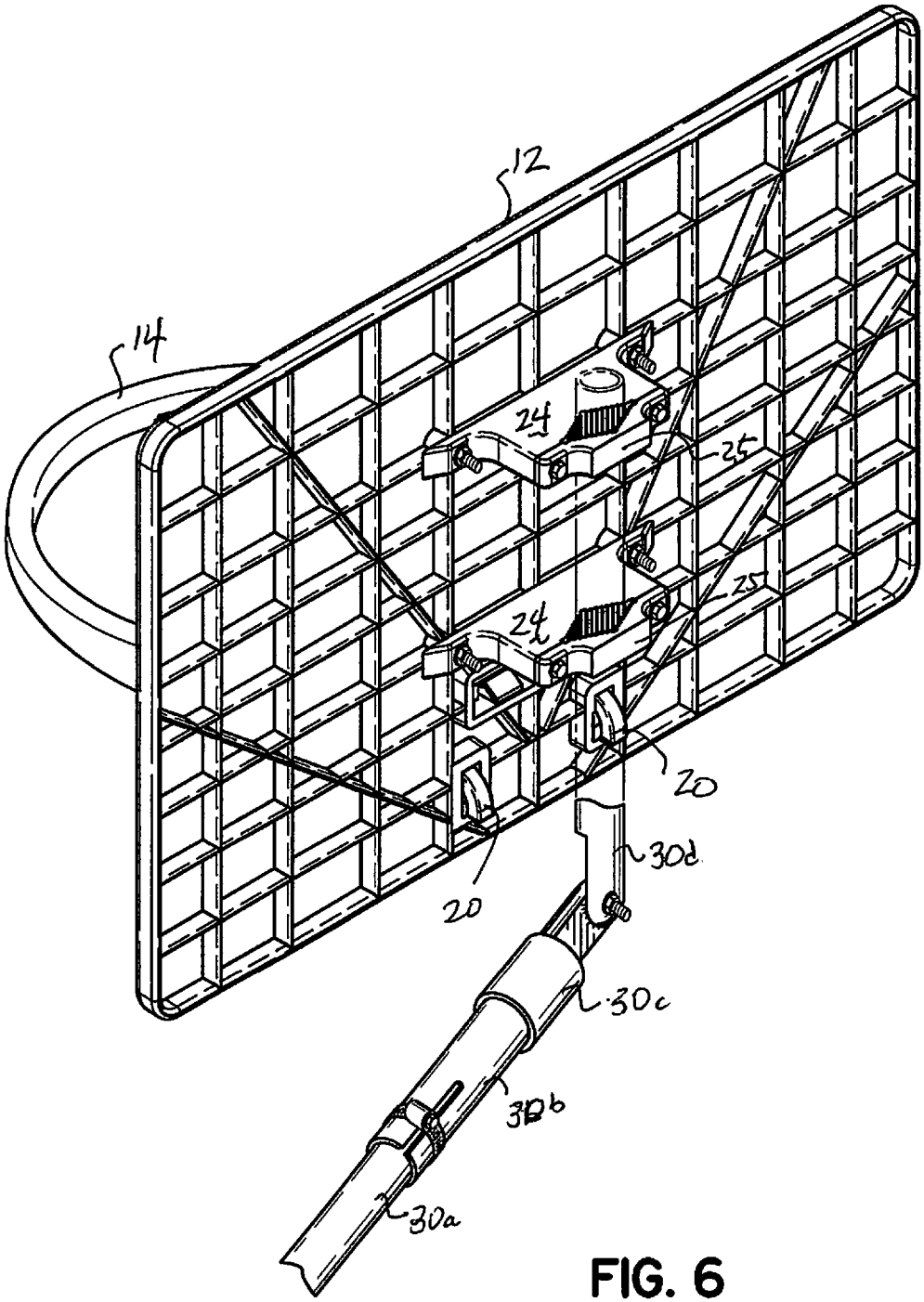
FIG. 6 is an illustration of a mounting post adapter installed on a mounting post that is at an acute angle relative to horizontal and vertical.

In those circumstances where neither a vertical or horizontal mounting post is available, a mounting post adapter 30*a*/30*b*/30*c*/30*d* such as seen in FIG. 6 may be installed on a mounting post. The adapter may be mounted to a post 30*a* that is at an acute angle relative to horizontal and vertical. The adapter comprises an upper tubing section 30*d* which is substantially vertical, an adjustable angle connecting member 30*c*, and a lower tube section 30*b*, including an enarged end for clamping to the mounting post using a pipe clamp, as illustrated. The lower tube section has longitudinal openings permitting the lower tube section to be installed over a variety of sizes of mounting posts, and engaged with the use of an appropriately sized pipe clamp.

Figure 6A:
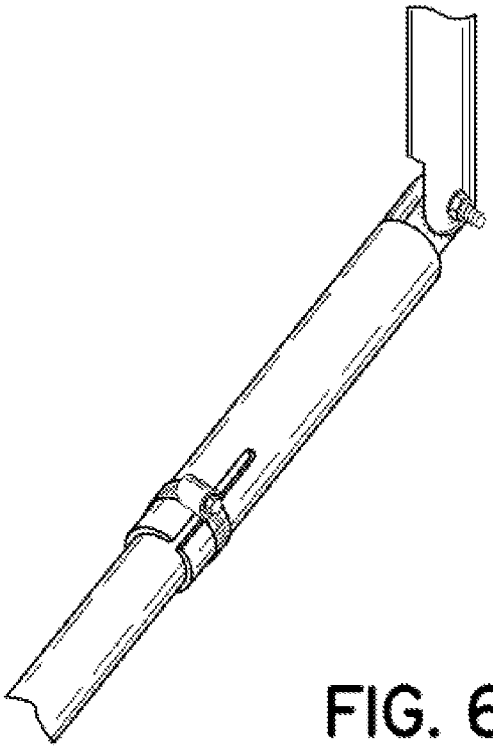
FIG. 6A is an illustration of a more streamlined implementation of the mounting post adapter lower tube, which does not include a pipe coupling joint in the lower tube section.

FIG. 6A is an illustration of a more streamlined implementation of the mounting post adapter lower tube, which does not include a pipe coupling joint 30*c* in the lower tube section.

The invention has been described herein with reference to specific embodiments, and those embodiments have been explained in substantial detail. However, the principles of the present invention are not limited to such details which have been provided for exemplary purposes. Variations will be apparent to one of ordinary skill in the art, and those too are within the scopes of the present invention.

What is claimed is:

1. The backboard and hoop device comprising:

a. a backboard section, b. a hoop section, c. first and second curved tangs at the proximal end of the hoop section, d. first and second hooked tangs at the proximal end of the hoop section, e. the backboard section including spaced first and second apertures sized to permit rotation of the curved tangs therein, and third and fourth apertures sized to permit engagement of the hooked tangs when aligned by rotation of the curved tangs, permitting assembly of the backboard section.

2. The backboard and hoop device of claim 1 further comprising a mounting post clamp comprising two pairs of first and second jaws, one of each pair of jaws being mountable in a vertical or horizontal orientation to the backboard member, and the other of each pair of jaws engaged to a vertical or horizontal mounting post.

3. The backboard and hoop device of claim 2 wherein the clamped distance between the first and second jaws of each pair is adjustable for a different size of mounting post.

4. The backboard and hoop device of claim 2 further comprising a mounting post adapter comprising an upper tube section for installation in the mounting post clamp, a lower tube section for clamping to a mounting post, and an adjustable angle connecting member positioned between the upper and lower tube sections.

5. The backboard and hoop device of claim 4 wherein the lower tube section defines longitudinal openings for resiliently capturing a mounting tube.

* * * * *